United States Patent [19]

Nakamura et al.

[11] Patent Number: 4,511,363

[45] Date of Patent: Apr. 16, 1985

[54] METHOD OF UPGRADING LOW-RANK COAL

[75] Inventors: Yoichi Nakamura; Akio Yamamoto, both of Kudamatsu; Shunsuke Nogita, Hitachi; Toshio Kuge, Hitachi; Katsumi Muroi, Kudamatsu, all of Japan

[73] Assignee: Hitachi, Ltd., Tokyo, Japan

[21] Appl. No.: 535,048

[22] Filed: Sep. 23, 1983

[30] Foreign Application Priority Data

Oct. 1, 1982 [JP] Japan ..... 57-170852

[51] Int. Cl.[3] ..... C10L 9/08

[52] U.S. Cl. ..... 44/1 G; 44/1 B; 44/6

[58] Field of Search ..... 44/1 G, 1 F, 1 B, 6

[56] References Cited

U.S. PATENT DOCUMENTS 4,249,909 2/1981 Comolli ..... 44/1 G 4,396,393 8/1983 Li et al. ..... 44/1 G

FOREIGN PATENT DOCUMENTS 2917563 11/1980 Fed. Rep. of Germany ..... 44/1 B

*Primary Examiner*—Carl F. Dees

*Attorney, Agent, or Firm*—Antonelli, Terry & Wands

[57] ABSTRACT

This invention relates to a method of upgrading low-rank coal and comprises the steps of dehydrating crushed low-rank coal using a rotary drum in a drying section, dry distilling the low-rank coal dehydrated in the drying section in a rotary drum in a dry distillation section, and cooling subsequently the low-rank coal low temperature dry-distilled in the dry-distillation section in a cooling section and enabling the low-rank coal to adsorb tar that is produced from the low-rank coal in the dry-distillation section. The present invention makes it possible to upgrade continuously large quantities of the low-rank coal with a high moisture content, and hence a low calorific value, to an upgraded coal with an increased calorific value which is not prone to spontaneous generation.

10 Claims, 7 Drawing Figures

METHOD OF UPGRADING LOW-RANK COAL

BACKGROUND OF THE INVENTION

1. Field of the Invention

This invention relates generally to a method of upgrading low-rank coal, and more particularly to a method which is suitable for upgrading low-rank coal with a high moisture content, and hence a low heating value, to produce coal with an increased calorific value.

2. Description of the Prior Art

Almost all the coals widely used as fuel are high-rank coals such as bituminous coal. However, low-rank coals such as lignite and subbituminous coal make up about a quarter of the coal on earth but are not sufficiently utilized because they have a large moisture content, or both a large moisture content and a large ash content, or a large ash content, and hence have a low heating value. In order to utilize these low-rank coals effectively as fuel, it is necessary to reduce the moisture and ash content, or either of the moisture content and the ash content, and upgrade them to coals having an increased calorific value.

However, since high-rank coals are primarily used at present, as stated above, suitable upgrading techniques for the effective utilization of low-rank coals yet remain at the research level and are incomplete.

The most popular method of conventional techniques of upgrading low-rank coals is to reduce the large moisture content of low-rank coal by a dryer. A railway transportation test of dried low-rank coals conducted at Grand Forks Energy Research Center, U.S.A., can be cited as typical of such attempts. If the large moisture content of the low-rank coal is merely reduced by a dryer, however, the dehydrated low-rank coal will absorb moisture from the atmosphere or rain water so that the moisture content of the low-rank coal will again increase, and the coal can not be used efficiently. In addition, such a method can not solve the problem that low-rank coals are inherently prone to spontaneous combustion.

Another conventional method is typified by the so-called "Fleissner process" which does not merely dry low-rank coal but modifies its properties per se. In the Fleissner process, low-rank coal is heated at an increased pressure which produces the moisture without evaporating it, and makes the low-rank coal hydrophobic. Accordingly, this process can improve the moisture-proofed property of low-rank coal, and is therefore an effective method of upgrading low-rank coals. In order to upgrade a large mass of low-rank coal by this process, however, an autoclave must be employed and this results in an increase in the cost of equipment. Moreover, since the heat treatment of low-rank coal using an autoclave is carried out in batches, this process is not really suitable for upgrading low-rank coal in practice because the output of low-rank coal is as much as 1,000,000 tons a year.

Still another method of modifying the properties of low-rank coal which does not simply dry it is reported in an article by Obita et al entitled "A Study on the Upgrading of Low-Grade Coals by Heat Treatment", Mitsubishi Juko Giho, Vol. 19, No. 3 (1982-5). In this method, low-rank coal is heated rapidly at normal pressure using a fluidized bed to produce tar on the surface of the low-rank coal, and the tar is kept on the surface of the low-rank coal immediately before it evaporates to vapor. Although this is effective as an method of upgrading low-rank coal, the time during which the properties of the low-rank coals are modified is not sufficiently long because the heat treatment is carried out at high speed, so that the low-rank coal is not rendered sufficiently hydrophobic. Moreover, since a fluidized bed system must always be employed, a critical limitation is imposed upon the particle size of the coal supplied. For these reasons, this method is not really suitable for upgrading low-rank coal on a practical scale.

SUMMARY OF THE INVENTION

The main object of the present invention is to provide a method of upgrading low-rank coal by continuously upgrading large quantities of low rank coal containing large moisture content, and hence a low heating value, to coal having an increased calorific value.

It is another object of the present invention to provide a method of upgrading low-rank coal to provide an improved moisture-proofed property and can continuously upgrade large quantities of low-rank coal to coal which is not prone to spontaneous combustion, by reducing the speed of any oxidation reaction.

The method of the present invention comprises a step of dehydrating crushed low-rank coal in a drying section using a rotary drum, a step of dry-distilling the dehydrated low-rank coal in a dry-distillation section using a rotary drum, and a step of cooling the low-rank coal that has been distilled in the dry distillation section, in a cooling section to enable the low-rank coal to adsorb the tar produced from it in the drying section. The method of the present invention can dehydrate large quantities of low-rank coal of a large moisture content continuously, and can render it hydrophobic and moisture-proofed.

DESCRIPTION OF THE PREFERRED EMBODIMENTS

Figure 1:
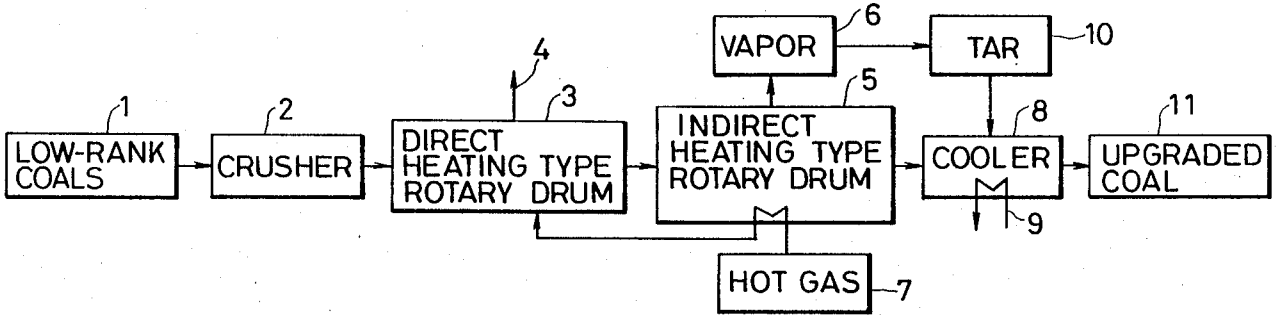
FIG. 1 is a flow diagram of an example of the process of upgrading low-rank coal to which the present invention is applied.

It is important when upgradng low-rank coal to dehydrate and dry the low-rank coal and dry-distill the low-rank coal in order to pyrolyze the hydrophilic oxygen-containing groups forming part of the low-rank coal to make the coals hydrophobic. In the present invention, the dehydration of the low-rank coal and its dry distillation are separated for the following reasons.

In the present invention, the low-rank coal is first dehydrated in a drying section and the dehydrated low-rank coal is then dry-distilled in a dry distillation section.

(1) Low-rank coal contains between about 20 to about 30% moisture (based on wet coal). When heated to a temperature of above 100° C. at atmospheric pressure, the moisture becomes a vapor and leaves the low-rank coal. When dry distillation is carried out, on the other hand, it is necessary to heat the low-rank coal to between 250° to 450° C. at atmospheric pressure, although this temperature varies according to the kind of coal.

If the dehydration and the dry distillation are carried out simultaneously, the vapor generated by the evaporation of the moisture contained in the low-rank coal is also heated unnecessarily to between 250° to 450° C. dry distillation. This unnecessary heating can be avoided by carrying out the dehydration and the dry distillation separately, and hence the expense of upgrading the low-rank coal can be reduced.

(2) Water, gas and tar (hereinafter called "mixed vapors") are produced from the low-rank coal when it is dry-distilled in the dry-distillation section. It is necessary that the tar in the mixed vapors is kept adsorbed onto the low-rank coal that is dry-distilled in the dry distillation section and is subsequently cooled in the cooling section. If the dehydration and the dry distillation are carried out simultaneously, only the tar must be isolated from the mixed vapors which account for about 30 to about 40% of the low-rank coal. If the dehydration and the dry distillation are carried out separately, on the other hand, the tar may be isolated from the mixed vapors which accounts for about 10% of the low-rank coal, and the installation cost is $\frac{1}{3}$ to $\frac{1}{4}$ of that when the dehydration and the dry distillation are carried out simultaneously. When the mixed vapors are brought into contact with low-rank coal that has been dry-distilled and cooled so as to let the coals adsorb the tar, a greater quantity of moisture is also adsorbed together with the tar because the proportion of tar in the mixed vapors when the dehydration and the dry distillation are carried out simultaneously is $\frac{1}{3}$ to $\frac{1}{4}$ of that when they are carried out separately. If the quantity of moisture adsorbed by low-rank coal that has been dry-distilled is assumed to be the same as that when the dehydration and the distillation are carried out separately, the quantity of tar adsorbed by the low-rank coal that has been dry-distilled and cooled is undesirably smaller than when the dehydration and the dry distillation were carried out simultaneously.

(3) The moisture produced in the drying section is extremely clean, but the moisture produced in the dry-distillation section has various substances dissolved therein. Accordingly, the moisture produced in the drying section can be discharged as it is, but the moisture produced in the dry-distillation section must be discharged after some necessary processing. If the dehydration and the dry-distillation are carried out simultaneously, all the moisture produced must be processed. The amount of moisture needing processing would be several times that when the dehydration and the dry-distillation are carried out separately, and this is uneconomical from the equipment point of view.

Next, the selection of the apparatus for the dehydration and dry distillation of the low-rank coal is discussed. It is important in this case that the apparatus can process large quantities of coal continuously, and can be operated with a high level of reliability.

One apparatus which can process large quantities of low-rank coal continuously is a dry-distillation apparatus with a vertically moving bed. Preliminary experiments were therefore carried out to upgrade low-rank coal using this apparatus. As a result, it was found that, although the apparatus could upgrade low-rank coal satisfactorily, an extended period of time was necessary for the heat transfer and as much as three to five hours was necessary for the dehydration and dry distillation of the low-rank coal. Accordingly, the apparatus was found to have practical problems in the upgrading of low-rank coal. Although the problem of clogging of the apparatus by the coal did not occur in the preliminary experiments, clogging by the coal could possibly occur due to the structural features of the dry-distillation apparatus with the vertical moving bed and, therefore, this type of apparatus has the possibility of not operating at a high level of reliability.

An examination was therefore made of a rotary drum which can process large quantities of coal continuously, which is unlikely to have the problem of clogging by the coal, due to its structure, and which would therefore operate at a high level of reliability. The greatest worry with this apparatus was that if an indirect heating type of rotary drum was used, the heat transfer would drop and the heating of the coal could not be done as desired, so that the heat treatment time would be extremely long.

Accordingly, preliminary experiments on upgrading low-rank coal were carried out using an indirect heating type of rotary drum. A plurality of fins were fitted into the drum of the indirectly heated rotary drum in order to improve the heat transfer. As a result, it was found that low-rank coal could be processed within an unexpectedly short period of time, and the low-rank coal could be upgraded sufficiently within about one hour, including the dehydration and dry distillation steps.

On the basis of the examination and results of the preliminary experiments, a rotary drum is selected as the apparatus for the dehydration and dry distillation of low-rank coal.

Hereinafter, one embodiment of the present invention will be described with reference to FIG. 1.

In FIG. 1, the low-rank coals 1 is crushed to a suitable size by a crusher 2. The term "suitable size" means generally the dimensions of the coal when it is supplied, the maximum particle diameter ranges from about 38 to about 50 mm. If the particle size of the low-rank coal supplied is already below this suitable size, crushing of the low-rank coal by the crusher 2 can be omitted.

Incidentally, if the maximum size of the particles of low-rank coal 1 supplied is controlled, the particle size distribution does not need to be limited in any particular way. Low-rank coal whose maximum particle size is between about 38 to about 50 mm and is crushed by the crusher 2 (hereinafter called "crushed coal") is first sent to a drying section where it is supplied to a direct heating type rotary drum 3 and dehydrated therein. In this case, the crushed coal is heated to a temperature of between 100° to 150° C. at atmospheric pressure which is sufficient for evaporating the moisture contained in the coal. In this case, since the crushed coal is heated directly by hot gas 7 within the direct heating type rotary drum 3, the mixed gas 4 consisting of hot gas and the water vapor produced from the crushed coal is discharged out of the direct heating type rotary drum 3. Next, the low-rank coal which has been heated by hot gas 7 within the direct heating type rotary drum 3 in the drying section and whose moisture content has been reduced (hereinafter called the "dehydrated coal") is sent to a dry distillation section and fed into an indirect heating type rotary drum 5, where it is subjected to dry distillation. In this case, the temperature that the dehydrated coal is heated to is between 250° to 450° C. at atmospheric pressure which is necessary for pyrolyzing the hydrophilic oxygen-containing groups constituting part of the dehydrated coal, for producing the tar and the water of pyrolysis from the dehydrated coal, and for modifying the dehydrated coal to a coal with a strong hydrophobic property. Since the dehydrated coal is heated indirectly by hot gas 7 in the indirect heating type rotary drum 5 in this instance, vapor 6 consisting of tar and the water of pyrolysis produced from the dehydrated coal is generated. The coal which is thus heated and modified by hot gas 7 in the indirect heating type rotary drum 5 (hereinafter called the "dry-distilled coal") is then sent to a cooling section where it is cooled indirectly by cooling water 9 in a cooler 8. A rotary drum or a stationary drum with a built-in screw is used as the cooler 8 in this case. The temperature of the dry-distilled coal cooled by the cooler 8 is set to a maximum of 50° C. when it is stored so as to prevent spontaneous combustion of the coal during storage. While being cooled, the dry-distilled coal adsorbs tar 10 separated from the vapor 6. As a result, an upgraded coal 11 can be obtained which is dehydrated and has an improved moisture-proofed property due to the adsorption of tar. Because of the pyrolysis of the hydrophilic oxygen-containing groups in the dry distillation section and the adsorption of the tar in the cooling section, the speed of any low-temperature oxidation reaction is extremely reduced, and the upgraded coal 11 is not prone to spontaneous combustion.

Figure 2:
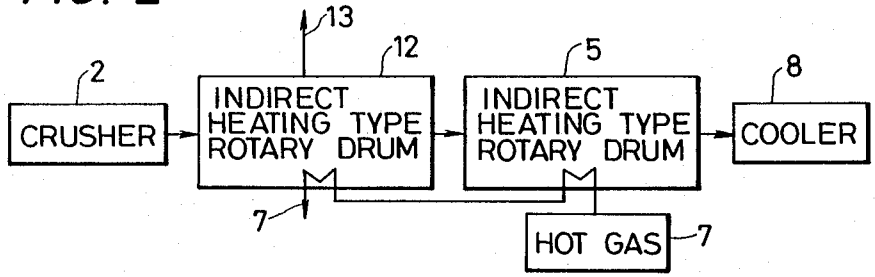
FIGS. 2 through 7 are flow diagrams of parts of the low-rank coal upgrading processes of six embodiments according to the present invention.

The low-rank coal upgrading process of the embodiment described above uses a direct heating type of rotary drum in the drying section, but an indirect heating type rotary drum 12 can be used instead, as shown in FIG. 2. In this case, water vapor 13 from the crushed coal and hot gas 7 are exhausted separately out of the indirect heating type rotary drum 12. An advantage of this arrangement over that of the embodiment described above is that since there is no hot gas in the vapor generated from the crushed coal, post-treatment of the vapor discharged from the indirect heating type of rotary drum is extremely easy. A disadvantage of this arrangement is that since the crushed coal is heated indirectly by the heating medium, the heat transfer is as effective as that of the embodiment described above that uses a direct heating type of rotary drum. However, this can be compensated for sufficiently by attaching a heat transfer tube at the center of the indirect heating type of rotary drum so as to increase the heat transfer area.

Figure 3:
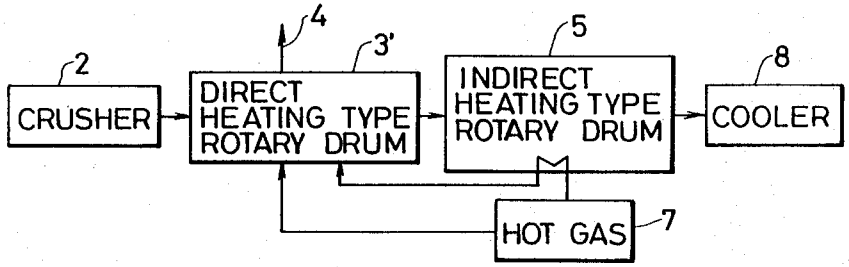
Figure 4:
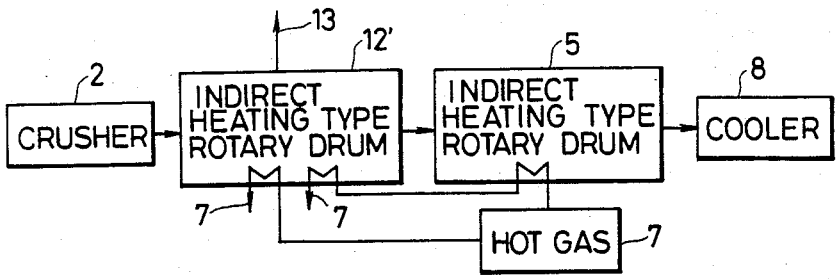

Low-rank coal generally contains 20 to 30% moisture (based on wet coal), and hence a larger quantity of the heating medium is required in most cases in the drying section than in the dry-distillation section. Because of this, a method of supplying the heating medium such as those shown in FIG. 3 or 4 can be employed. FIG. 3 shows a case in which a direct heating type rotary drum 3' is used in the drying section, and FIG. 4 shows a case in which an indirect heating type rotary drum 12' is used in the drying section. In FIG. 3, hot gas 7 used for the indirect heating type rotary drum 5 of the dry-distillation section and is then discharged and hot gas 7 that by-passes the indirect heating rotary drum 5 of the dry-distillation are supplied to the indirect heating type rotary drum 12'.

Figure 5:
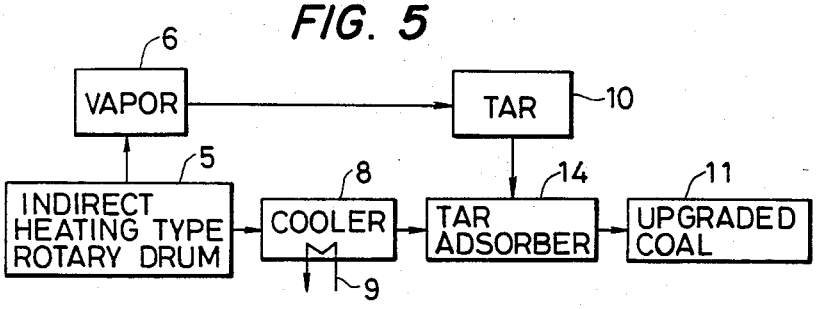

In the low-rank coal upgrading process of the embodiment described above, the adsorption of the tar 10 by the dry-distilled coal is effected in the cooler 8. In order to ensure a further adsorption of the tar 10 by the dry-distilled coal, however, it is possible to separate the cooling of the dry-distilled coal in the cooling section from the adsorption of the tar 10 by the dry-distilled coal, as shown in FIG. 5, and instead provide a tar adsorber 14 for adsorbing the tar 10 onto the dry distilled coal at a step before the cooler 8.

Figure 6:
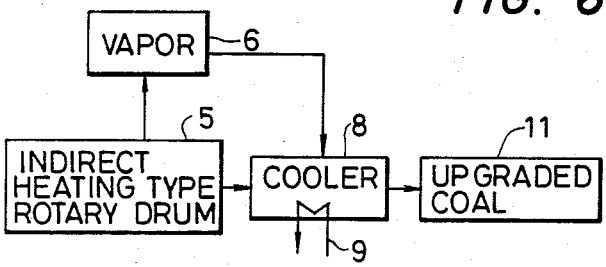
Figure 7:
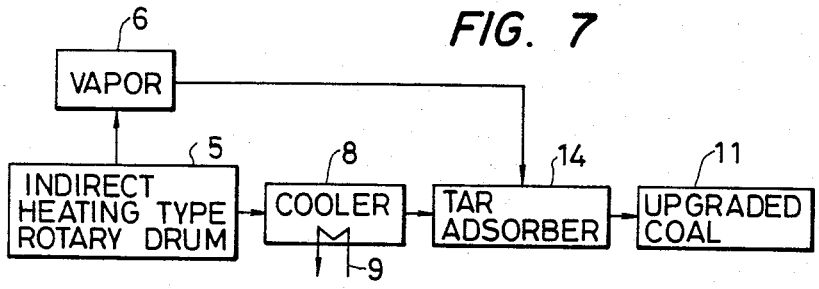

In the low-rank coal upgrading process of the embodiment described above, the tar is isolated from the vapor consisting of tar and the water of pyrolysis produced from the dehydrated coal in the dry-distillation section, and this tar is adsorbed by the dry-distilled coal in the cooling section. However, the tar could be selectively adsorbed by the dry-distilled coal without having to isolate the tar from the vapor by bringing the vapor generated in the dry-distillation section into contact with the dry-distilled coal in the cooling section, as illustrated in FIGS. 6 and 7. In FIG. 6, the vapor 6 generated in the indirect heating type rotary drum 5 in the dry-distillation section is supplied to the cooler 8 in the cooling section. The vapor 6 is brought into contact with the dry-distilled coal in the cooler 8, and the tar forming part of the vapor is selectively adsorbed by the dry-distilled coal, thus providing the upgraded coal 11.

In FIG. 7, the vapor 6 generated by the indirect heating type rotary drum 5 in the dry-distillation section is supplied to the tar adsorber 14 downstream of the cooler 8 in the cooling section. The vapor 6 is brought into contact with the dry-distilled coal by the tar adsorber 14, and the tar forming part of the vapor 6 is selectively adsorbed to obtain upgraded coal 11. If the vapor generated in the dry-distilled section is brought into contact with the dry-distilled coal in the cooling section so as to enable the dry-distilled coal to selectively adsorb the tar forming part of the vapor in the manner described above, the moisture content of the resultant upgraded coal is somewhat more than that of upgraded coal in which tar isolated from the vapor produced in the dry-distillation section is adsorbed by the dry distilled coal in the cooling section, but this method eliminates the necessity of isolating the tar from the vapor produced in the dry-distillation section, so that the running costs are reduced overall.

The resultant upgraded coal is much more pulverized than the low-rank coal fed to the drying section. This is due to embrittlement of the low-rank coal itself in the drying treatment in the drying section, and the dry-distillation treatment in the dry-distillation section. This embrittlement manifests itself concretely as an increase of in the HGI (Hard Grove Index). Pulverization is accelerated by the rotary drums in the drying and dry-distillation sections. The pulverization of the resultant upgraded coal poses no practical problem if the size of the particles supplied to the drying section is adjusted in advance. In order to prevent the occurrence of dust in the coal yard, it is not desirable that a lot of dust coal occurs from the pulverized coal. To minimize the occurrence of dust coal, the rotational speed of the rotary drums in the drying and dry-distillation sections must be reduced by as much as possible. More definitely, the rotary drums in the drying and dry-distillation sections are preferably operated at 5 rpm or less because the quantity of fine coal produced increases dramatically at above 5 rpm.

EXPERIMENTAL EXAMPLE 1

Upgrading of a low-rank coal with a moisture content of 25.3% (based on wet coal) and a calorific value of 4,840 kcal/kg (based on wet coal) was carried out, based on the low-rank coal upgrading process of the embodiment described already. The low-rank coal was crushed to a maximum particle diameter of 25 mm, the crushed coal was heated in the drying section to a temperature of 110° C. at atmospheric pressure, the dehydrated coal was heated in the dry-distillation section to a temperature of 400° C. at atmospheric pressure, and the dry-distilled coal was cooled in the cooling section to 50° C. The temperature of the tar adsorbed by the dry-distillated coal was 350° C. As a result, an upgraded coal with a moisture content of 7.4% (based on wet coal) and a calorific value of 6,170 kcal/kg (based on wet coal) could be obtained. The speed of the low temperature oxidation reaction was slowed considerably from 2.6 mcal/g.coal.min to 1.4 mcal/g.coal.min, and the resultant coal was not prone to spontaneous combustion.

EXPERIMENTAL EXAMPLE 2

Upgrading of the same low-rank coal as that used in Experimental Example 1 was carried out under the same conditions as those of Experimental Example 1. In this case, however, the adsorption of the tar by the dry-distilled coal was carried out by bringing vapor into contact with the dry-distilled coal without isolating the tar from the vapor. As a result, not only the tar constituting part of the vapor, but also the moisture of the vapor, were adsorbed by the dry distilled coal, but the eventual moisture content of the upgraded coal was found to be 6.1% (based on wet coal). When the temperature of the dry-distilled coal was 100° C., 80% of the tar and the 50% of the moisture were adsorbed.

EXPERIMENTAL EXAMPLE 3

Upgrading of the same low-rank coal as that used in Experimental Example 1 was carried out under the same conditions as those of Experimental Example 1. In the upgrading process, the rotational speed of the rotary drums in the drying and dry-distillation sections was set at 10 rpm, and the resultant upgraded coal was thus somewhat pulverized. More definitely, whereas there was 7% fine coal of under 250 μm in particle size in the low-rank coal supplied to the drying section, 13% fine coal was found in the resultant upgraded coal. On the other hand, when the rotary drums of the drying and dry-distillation sections were operated at 2 rpm, the proportion of fine coal in the resultant upgraded coal dropped to 10%. When the rotary drums of the drying and dry-distillation sections were operated at 5 rpm, the proportion of fine coal in the resultant upgraded coal was the same as that of the upgraded coal when the speed of the rotary drums was 2 rpm.

As described above, the present invention comprises a step of dehydrating crushed low-rank coal using a rotary drum in a drying section, a step of dry distillating the low-rank coal dehydrated in the drying section at a low temperature in a rotary drum in a dry-distillation section, and a step of subsequently cooling the low-rank coal upgraded in the dry-distillation section in a cooling section, and letting the upgraded coal adsorb tar produced from the low-rank coal in the dry-distillation section. Accordingly, the present invention provides the advantage that low-rank coal with a large moisture content, and hence a low calorific value, can be upgraded continuously on a mass basis to upgraded coal having an increased calorific value. Since the low-rank coal is made hydrophobic by pyrolysis of the hydrophilic oxygen-containing groups in the dry-distillation section and by the adsorption of tar in the cooling section, an improved moisture-proofed property can be provided for the low-rank coal, the speed of low temperature oxidation reactions can be reduced markedly, and spontaneous combustion of the coal can be prevented.

What is claimed is:

1. A method of upgrading low-rank coal comprising:

dehydrating low-rank coal in a drying section, by heating to a temperature of between 100° to 150° C. to remove moisture therefrom;

delivering the dehydrated coal from said drying section to a dry-distillation section;

dry-distilling said dehydrated coal by heating to a temperature of between 250°–450° C. in the dry-distillation section to produce dry-distilled coal and vapor containing tar;

delivering said dry-distilled coal from said dry-distillation section to a cooling section, cooling said dry-distilled coal in the cooling section and contacting the cooled dry-distilled coal with said vapor to enable the cooled dry-distilled coal to absorb tar from said vapor.

2. The method of upgrading low-rank coal as defined in claim 1, wherein said vapor produced from said dry-distillation of said dehydrated coal consists essentially of said tar and water of pyrolysis, wherein said vapor is withdrawn from said dry-distillation section and thereafter is separated into tar vapor and vapor of the water of pyrolysis, and then the separated tar vapor is delivered to said cooling section where said separated tar is absorbed by said cooled dry-distilled coal.

3. The method of upgrading low-rank coal as defined in claim 1, wherein said vapor produced from said dry-distillation of said dehydrated coal consists essentially of said tar and water of pyrolysis, wherein said vapor is delivered from said dry-distillation section to said cooling section where said vapor is placed in contact with said cooled dry-distilled coal to enable said cooled dry-distilled coal to absorb the tar.

4. The method of upgrading low-rank coal as defined in claim 1, wherein cooling of said dry-distilled coal and absorption of said tar in said cooled dry-distilled coal are accomplished simultaneously in said cooling section.

5. The method of upgrading low-rank coal as defined in claim 1, wherein said cooling of said dry-distilled coal and absorption of said tar in said cooled dry-distilled coal are accomplished separately.

6. The method of upgrading low-rank coal as defined in claim 1, wherein said low-rank coal is dehydrated by direct heating with a hot gas.

7. The method of upgrading low-rank coal as defined in claim 1, wherein said low-rank coal is dehydrated by indirect heating with a hot gas.

8. The method of upgrading low-rank coal as defined in claim 1, wherein said dehydrated coal is dry-distilled by indirect heating.

9. The method of upgrading low-rank coal as defined in claim 1, wherein the low-rank coal is dehydrated at atmospheric pressure in a rotary drum and the dehydrated coal is dry-distilled at atmospheric pressure in a rotary drum.

10. The method of upgrading low-rank coal as defined in claim 1, wherein dry-distilled coal is cooled in said cooling section to a temperature of 50° C. or less.

* * * * *